US005105482A

United States Patent [19]

Flynn et al.

[11] Patent Number: 5,105,482

[45] Date of Patent: Apr. 21, 1992

[54] FLOW CONTROL APPARATUS, SYSTEM AND METHOD

[76] Inventors: Raymond F. Flynn; Margaret A. Flynn, both of 728 Great Fields Rd., Brewster, Mass. 02631

[21] Appl. No.: 559,683

[22] Filed: Jul. 30, 1990

[51] Int. Cl.[5] ..... E04H 3/19; B65B 1/04

[52] U.S. Cl. ..... 4/503; 4/496; 141/387; 137/614.21; 239/574; 134/174; 251/155

[58] Field of Search ..... 4/490, 496, 498, 503; 141/387; 137/614.2, 614.21, 485, 495; 239/574; 134/174; 251/155, 156; 417/234, 423.3

[56] References Cited

U.S. PATENT DOCUMENTS

| | | | |
|---|---|---|---|
| 3,667,070 | 6/1972 | Pitti et al. | 4/503 |
| 3,711,873 | 1/1973 | Katzmann | 4/503 |
| 4,006,754 | 2/1977 | Houston | 137/614.21 |
| 4,048,678 | 9/1977 | Chillino | 4/503 X |
| 4,534,512 | 8/1985 | Chow et al. | 239/574 X |
| 4,909,443 | 3/1990 | Takagi | 239/574 X |

FOREIGN PATENT DOCUMENTS

| | | | |
|---|---|---|---|
| 1428426 | 3/1969 | Fed. Rep. of Germany | 417/423.3 |
| 346109 | 6/1960 | Switzerland | 417/423.3 |

*Primary Examiner*—Henry J. Recla
*Assistant Examiner*—Glenn T. Barrett
*Attorney, Agent, or Firm*—Thomas A. Kahrl

[57] ABSTRACT

A water flow control device, using available swimming pool water for a source of water, adapted to be connected to conventional swimming pool hose apparatus for rapidly serving swimming pools for winter and spring cleanup. The flow control device can be used to rapidly fill water tubes, consisting of large vinyl bags which are used to anchor the four sides of conventional swimming pool cover used to cover swimming pools when not in use. The flow control device comprises a check valve, a nozzle, a hose section, a valve housing, a flow control handle, a flow chamber, a ball and a ball check seat. A swimming pool flow control system incorporating a source of water.

An improved flow control device, of 1½" id., conventional hose and water tube, a submersible pump connected to pump water at high volume, low pressure, adapted to receive standard pool vacuum hose, generally rectangle cover for covering a swimming pool, typically partially filled with water when not used during periods of nonuse, generally in the winter months and cold climates.

4 Claims, 1 Drawing Sheet

FLOW CONTROL APPARATUS, SYSTEM AND METHOD

BACKGROUND OF THE INVENTION

Swimming pools once installed are filled with water to the appropriate level to provide areas for recreational swimming. Thereafter due to the expense of the large volume of water needed to fill a swimming pool, and for reasons of protecting the walls of the pool from freezing and cracking, a pool is kept filled with water year round and the water is treated and cleaned as appropriate from time to time. Pool equipment used for cleaning typically includes a substantial length of "vacuum hose" so called as it is used to connect with a vacuum system to clean the pool and is generally standard equipment for pools.

Once the swimming pool has been filled however, maintenance thereof also requires the use and transfer of large volumes of water. Generally water used for such maintenance is drawn from a household system connected to a municipal water system or well system, and as the volume being in substantial amounts it is at a considerable cost to the user. Filling and transfer performed by a user typically is accomplished by use of a small diameter garden hose typically a half inch in diameter, and being of such small diameter transfers of such large volumes of water requires an extensive amount of time. When the cost of water used in pool maintenance is coupled with the expense of hiring personnel to conduct maintenance, the total amounts to a substantial expense.

A major item of maintenance of swimming pools is the installation of a removable swimming pool cover and anchoring it to cover the pool during the off seasons such as fall, winter and spring, as is appropriate. Such installation includes placing the cover over the entire top surface of the pool to keep out dirt and debris such as leaves, extending out and around the platform edges surrounding the edges of the pool. Next, "water tubes" comprising elongated cylindrically shaped vinyl plastic bags are laid along the four sides of the pool on top of the cover. These tubes are constructed in bag like fashion and vary in size from 4, 6, 8, 10 and 12 foot lengths in order to come up with the proper combination to extend along the entire sides and end portions of the pool. Next the tubes are filled with water, typically connecting a garden hose generally of one half or three quarter inch diameter, to a faucet connection installed in the household system in turn connected to a water system as a source of water. This procedure is very time consuming and uses a substantial amount of water, typically 150 gallons for a longitudinal tube and 100 gallons for the end tubes. Use of the garden hose typically introduces air along with water while filling the tube requiring venting and further slowing the process of filling.

A second item of pool maintenance comes in the spring, known as "spring clean-up" when the cover is removed and the pool is placed readiness for use for swimming and water activities. The areas are flushed with water around the pool and the cover and water tubs are removed. The cover itself requires a thorough rinsing, requiring a large volume of water to accomplish a thorough cleaning.

It is desirable however to provide for an improved, simple, yet effective flow control apparatus to provide for an improved flow control of water used in pool maintenance, to a system employing the improved flow control apparatus and to provide for a method of controlling the flow and distribution of water used in the maintenance of a swimming pool.

SUMMARY OF THE INVENTION

The present invention is directed to an improved flow control apparatus, a swimming pool filling system employing the improved flow control apparatus and to a method of controlling the flow and distribution of water used in the maintenance of swimming pools.

The present invention comprises an improved flow control apparatus which includes a nozzle control for providing high volume flow at low pressure positioned in a valve housing adapted to be attached to a flexible hose, connected to a pump for controlling the flow of water, particularly water used for pool maintenance and for filling water tubes used for anchoring swimming pools.

A simple inexpensive portable flow control apparatus and system has been discovered for rapidly filling water tubs used for anchoring swimming pool covers and for washing down swimming pools and equipment for cleaning.

The flow control apparatus is adapted to be used with a swimming pool of generally rectangular construction filled with water as a water source, having a plurality of horizontally extending platform edges typically four in number, a removable cover for seasonal use of generally rectangular construction having a size substantially larger than a swimming pool to cover not only the pool itself but the surrounding platform edges, a plurality of water tubs generally twelve (12) in number to be filled with water and placed on the four sides of the pool positioned over the platform edges on the portion of the peripheral edges of the cover. The flow control apparatus also includes a portable submersible pump to be positioned in the water contained in the swimming pool as desired by a user at such time as the water tubs are to be filled, a vacuum tube typically a one and a half inch diameter having a one end and an other end to be attached at the one end to a nozzle control apparatus and to the submersible pump at the other for pumping water from the pool into the water tubs.

The pump is adapted to be portable to be easily moved from one swimming pool location to another at the option of the user and is provided with an output port adapted to receive the other end of the vacuum hose to accept water output of the pump. In use the pump is lowered into the pool to be submerged under the surface of the water contained therein to utilize the water contained therein for filling water tubs or for flushing the pools exterior outwardly extending platform surfaces. Typically the pump is electrically powered and is constructed to pump water at low pressure and at high volume.

The tubs, generally twelve (12) in number comprise elongated cylindrically shaped vinyl bags to be laid along the four sides of the pool on top of the cover comprising eight (8) substantially long longitudinal tubs and four (4) smaller end tubs. The tubs being constructed in bag like fashion, varying in length to extend along the entire sides and end portions of the pool. Each tub is provided with a filling means to accept water from the nozzle control apparatus and once the bag is filled to be sealable closed.

The nozzle control apparatus is constructed of plastic material which is acid resistant is adapted to be fitted on the one end of a vacuum hose and comprises a plurality of check valve means, a valve control means, a valve housing, a flow chamber and a nozzle. The nozzle control apparatus is adapted to be attached to the one end of the vacuum hose and has an inlet and an outlet to permit water being pumped by a submersible pump through the vacuum hose to pass through the nozzle control apparatus with the check valve means open.

The flow control apparatus is adapted to provide a high volume flow of water at low pressure for use with the submersible pump. The source of water to be used is the water in the swimming pool. The hose connection between the submersible pump and the flow control apparatus is the conventional vacuum hose which having a diameter of one and a half inch which is a plastic flexible hose which is standard equipment for all swimming pools. The vacuum hose has a one end and other end and is adapted for carrying water in large volume at low pressure from the submersible pump submerged in the source of water comprising an annular collar at one end at the one end and at the other end for receiving a plurality of pool maintenance devices including a nozzle means and a pump.

The flow control apparatus may be employed in a flow control system whereby water contained in a swimming pool is pumped by a submersible pump through vacuum hose acting as a conduit for the pumped water including a housing having a one end and an other end the one end being adapted to fit into the annular collar attached to the other end of the vacuum hose in sealable cooperation therewith having an inner flow control chamber having an inlet and an outlet, a pair of opposed check valve means hingeably mounted in the flow control chamber for movement between an open filling position and a closed non-flowing position, wherein the check valve means are seated on a valve seat, a flow control device for moving the control check valve from a closed position to an open position to permit water to flow through the nozzle control apparatus and out the nozzle, a valve control means for opening and closing the control check valve to permit water to flow through the valve housing from the inlet end to the outlet end.

The method of the invention comprises providing water tubes to be filled and installed on a swimming pool cover, inserting a submersible pump, attached to a flexible vacuum hose, in water contained in a swimming pool below the surface; connecting the submersible pump to an electrical power means; attaching a flow control means to the other end of the flexible hose means; depressing the valve control means to move the check control means between a closed position and an open position; thereby permitting the other check valve to move between a closed position and an open position to permit water to flow from the inlet end of the nozzle control apparatus to the outlet end and filling the water tube previously placed on the outer perimeter of the platform of the swimming pool by placing the water control apparatus in the filling orifice of the water tube. Covering the pool is accomplished by placing a swimming pool cover over the top of a swimming pool with its outwardly extending lateral edges extending over platform edges of the swimming pool, thereafter placing water tubes on the outer perimeter of the platform of the swimming pool cover; placing the water control apparatus in the filling orifice and thereafter energizing the submersible pump to pump water through the vacuum hose and depressing the valve control means to permit water to open the check valve means to permit water to pass in a high volume through the nozzle control apparatus into the water tube all without pumping air entrapped in the vacuum hose into the water tube.

In the absence of the check valves the water would drain back into the pool creating a column of air in the hose which would have to be pumped out prior to filling a second tub causing a substantial delay in filling.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DESCRIPTION OF THE EMBODIMENTS

Figure 1:
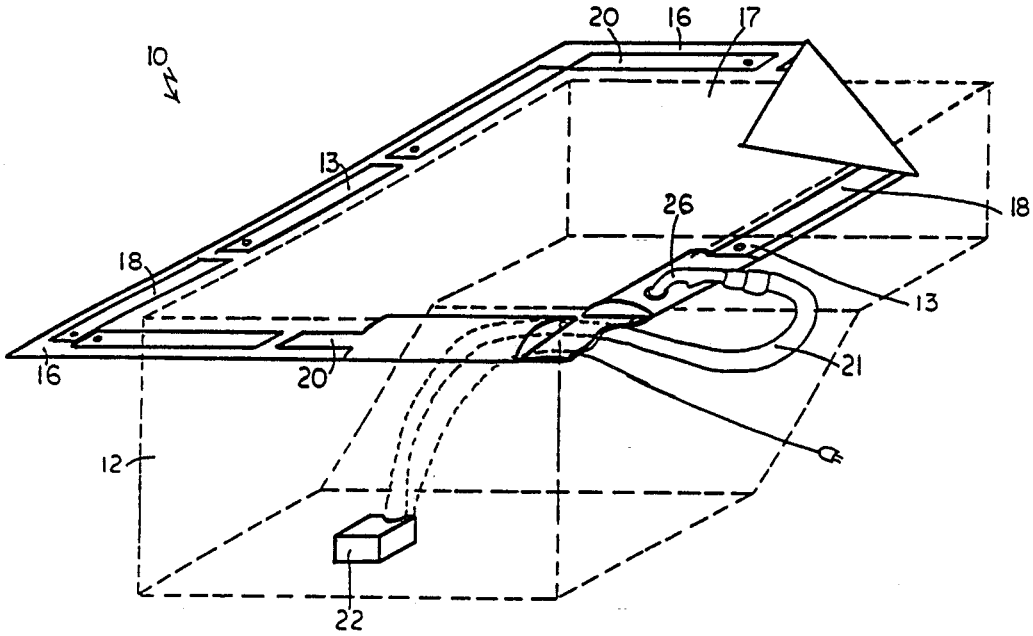
FIG. 1 is a perspective view of the swimming pool filling system of the invention showing the employment of the improved flow control apparatus.

With reference to the drawings, FIG. 1 shows a swimming pool filling system for water tubes 10 including a swimming pool 12 having a first and second longitudinal platform edges 13 and a first and a second end platform edge 16, a cover 17, a plurality of longitudinal water tubes 18 and a plurality of end water tubes 20, the cover 17 extending horizontally from the first platform edge 14 to the second platform edge 16 and from the first end platform edge to the second platform edge 16 to entirely cover the swimming pool 12.

Figure 2:
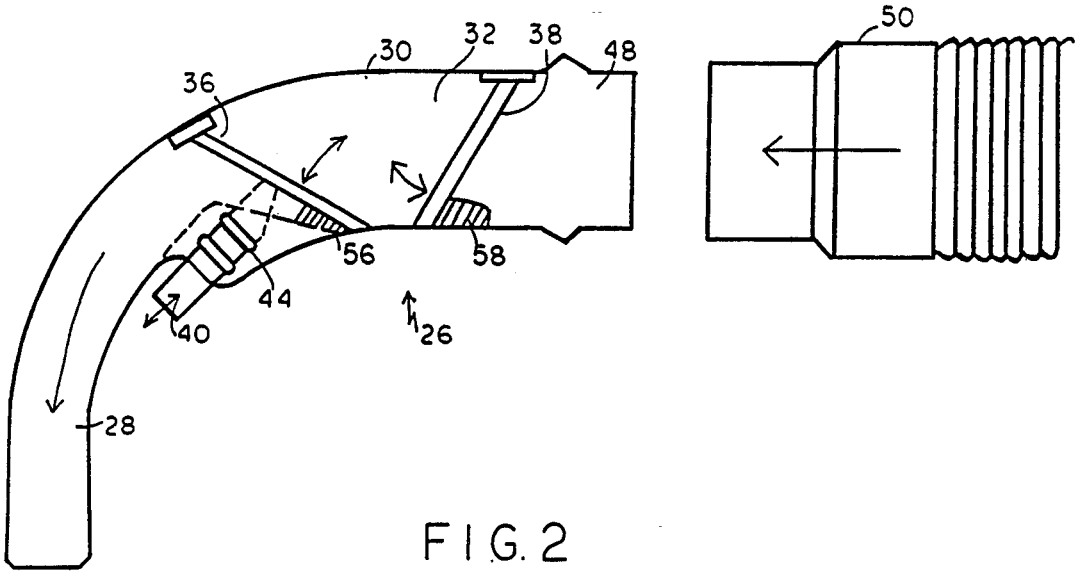
FIG. 2 is a side view of the flow control apparatus of the invention shown in sections.

FIGS. 1 and 2 illustrate the flow control apparatus 21 comprising a submersible pump 22 typically a portable electrically powered submersible pump for positioning in the swimming pool 12 below the surface of the water, a flexible length of vacuum hose 24 having a one end and an other end, the one end being attached to the submersible pump 22, the other end being attached to the nozzle control apparatus 26 with a water tight sealable fit.

The nozzle control apparatus 26 comprises a nozzle 28, a valve housing 30 including a flow control chamber 32 having an inlet end and an outlet end including a pair of opposed flexibly mounted check valves comprising a control check valve 36 and an opposed check valve 38 mounted in the flow control chamber 32 for movement between a closed air locking position and an open flow position, a valve control piston 40 mounted in a passage way provided in the inner grip section 44 of the valve housing 30 the nozzle 42 having a 90 degree bend. The housing 30 is provided with an annular fitting 48 adapted to slideably fit in the end of the vacuum hose with a shoulder 50. When water is introduced into vacuum hose 24 flowing from the vacuum hose into the flow control apparatus 21 under pressure created by submersible pump 22, check valve 38 swings open and away from it's normal resting position against check valve seat 58 to permit water to flow into flow control chamber 32. Flow control chamber 32 is disposed between check valve 38 and control check valve 36. Said control check valve depends from a hinge fastener on the wall of the nozzle and is positioned to normally rest against the control check valve seat 56, thereby preventing flow from the flow control chamber 32 into the nozzle 28, control check valve. When water enters the flow control chamber 30 it acts against the interior surface of the check valve 36 to force it against check valve seat 56 to prevent the flow of water out the nozzle 28. Check valve 38 is normally open at all times that water is pumped through the vacuum hose from the submersible pump to the nozzle 28. At such time as the submersible pump is deenergized by a switch 52, water tends to return into the pool via the vacuum hose creating a vacuum in the area of the annular fitting 48 causing the check valve 38 to close into the closed air locking position from the normal open flow position, thereby preventing water from draining from the vacuum hose.

The vacuum hose 24 is adapted as shown in FIG. 1 to extend from the submersible pump 22 and to fit under a portion of the cover 17 constructed of flexible material. In normal operation, a portion of the cover is turned back upon itself to provide an opening as shown in FIG. 1.

The operation of the submersible pump 22 is controlled by connecting the electrical cord 53 to a conventional electrical outlet to energize the said pump 22 and by disconnecting said electrical cord 53 from said conventional electrical outlet for deenergizing said pump 22.

What is claimed is:

1. In a swimming pool flow control system for controlling the flow of water adjacent a swimming pool;

a) a swimming pool containing a volume of water having laterally extending deck areas;

b) a cover for covering the swimming pool and deck areas having a plurality of edges;

c) a plurality of water container means for placement on the edges of the cover extending over the deck areas for anchoring the edges of the cover;

d) a vacuum hose having a one end and an other end for providing a conduit of pump water, the improvement comprising;

e) a pump means positioned in the water contained within the swimming pool being connected to the other end of the vacuum hose for pumping water from the swimming pool and for filling the water containers with water;

f) a flow control means adapted to be attached to the one end of the vacuum hose for controlling the flow of water pumped by the submersible pump means into the vacuum hose means and for providing a check valve means to prevent backflow of water which would otherwise empty the water in the vacuum hose comprising;

i) a pair of opposed hinged flap valves comprising a control check valve and an opposed check valve;

ii) a valve housing having an inlet end an an outlet end, a flow control chamber and a nozzle at the outlet end;

iii) a valve control means moving the control check valve between a closed position and an open position.

2. The flow control apparatus of claim 1 wherein the submersible pump operates to produce a low pressure and high volume output.

3. A high volume flow control apparatus for use with a submersible pump comprising;

a) a source of water;

b) a hose means having a one end and an other end for carrying water in large volumes and at low pressure from a submersible pump submerged in the source of water, comprising a first annular collar at one end for receiving a pump outlet and a second annular shoulder at the other end;

c) a pump;

d) a nozzle means adapted to be attached to the one end of the hose means comprising;

i) a housing having a one end and an other end, the one end being adapted to fit into the annular collar attached to the other end of the vacuum hose in sealable cooperation therewith, having an inner flow control chamber and having an inlet and an outlet;

ii) a pair of opposed check valve means hingably mounted within the flow control chamber for movement of each check valve means between an open position and a closed non-flowing position;

iii) a housing having a one end and an other end, the one end being adapted to fit in the annular collar attached to the other end of the vacuum hose in sealable cooperation;

iv) control means for moving the first check valve between a closed position and an open position comprising a piston sealably mounted in the housing, the piston being movable between a extended position and a depressed position wherein the piston extends into the housing for engagement with the first check valve to lift the check valve off it's seat.

4. A method of controlling the flow and distribution of water for servicing swimming pools which method comprises;

a) providing a swimming pool having laterally extending deck areas extending outwardly from the pools peripheral edges and having a cover for enclosing the pool;

b) providing a submersible pump attached to a flexible vacuum hose in water contained in a swimming pool below the surface;

c) connecting the submersible pump being connected to an electrical power means;

d) attaching a nozzle means for controlling the flow of water by the operation of opening and closing check valves to the other end of the flexible hose means;

e) placing a swimming pool cover over the top of a swimming pool with its outwardly extending lateral edges extending over platform edges of the swimming pool;

f) placing four water bags on the four sides of the platform of the swimming pool on the platform edges on top of the outer peripheral edges of the swimming pool cover;

g) energizing the submersible pump to commence pumping water through the vacuum hose means connected to a flow control apparatus thereby activating the valve control means to move the control check valve between a air locked closed position and an open position thereby permitting the opposed check valve to move between a closed position and an open position to permit water to flow from the inlet end of the nozzle control apparatus to the outlet end for servicing the swimming pool and filling water tubes.

* * * * *